US006131787A

United States Patent [19]

Curtis

[11] Patent Number: 6,131,787

[45] Date of Patent: Oct. 17, 2000

[54] TWO-PIECE NAILER MAGAZINE AND METHOD THEREFOR

[75] Inventor: Patrick J. Curtis, Oak Lawn, Ill.

[73] Assignee: Illinois Tool Works Inc., Glenview, Ill.

[21] Appl. No.: 09/363,331

[22] Filed: Jul. 27, 1999

[51] Int. Cl.[7] ..... B25C 3/00; B25C 7/00

[52] U.S. Cl. ..... 227/120; 227/156

[58] Field of Search ..... 227/120, 109, 227/135, 136, 127, 156

[56] References Cited

U.S. PATENT DOCUMENTS

| | | | |
|---|---|---|---|
| D. 406,999 | 3/1999 | Sover et al. | D8/69 |
| 4,326,661 | 4/1982 | Maurer et al. | 227/120 |
| 4,389,012 | 6/1983 | Grikis et al. | 227/120 |
| 4,715,522 | 12/1987 | Jordan | 227/120 |
| 4,784,306 | 11/1988 | Baum | 227/120 |
| 5,083,694 | 1/1992 | Lemos | 227/120 |
| 5,163,596 | 11/1992 | Ravoo et al. | 227/120 |
| 5,297,713 | 3/1994 | Perra et al. | 227/120 |
| 5,433,367 | 7/1995 | Liu | 227/120 |
| 5,588,577 | 12/1996 | Chen | 227/120 |
| 5,641,110 | 6/1997 | Yang | 227/120 |
| 5,695,108 | 12/1997 | Lee | 227/120 |
| 5,743,453 | 4/1998 | Chuang | 227/120 |
| 5,816,469 | 10/1998 | Ohuchi | 227/120 |
| 5,839,638 | 11/1998 | Ronn | 227/120 |
| 5,873,509 | 2/1999 | Liao | 227/120 |
| 6,012,622 | 1/2000 | Weinger et al. | 227/120 |

OTHER PUBLICATIONS

ITW Paslode, "Model 3250 / 65–F16 Finish Nailer", Apr. 1997, 4 pages.

ITW Paslode, "Model F–350S Strip Nailer", Feb. 1997, 4 pages.

*Primary Examiner*—Peter Vo
*Assistant Examiner*—Jim Calve
*Attorney, Agent, or Firm*—Lisa M. Soltis; Mark W. Croll; John P. O'Brien

[57] ABSTRACT

A two-piece magazine for strips of nails in nailing tools, combinations thereof and methods therefor including first and second magazine portions each having an elongated side wall with front and rear end portions. The first magazine portion includes a first lower portion with a tongue protruding therefrom, and the second magazine portion includes a second lower portion with a groove. The tongue is disposable and frictionally retainable in the groove to assemble the first and second magazine portions. The first and second magazine portions are formed preferably at least partially by extrusion and partially in one or more stamping operations.

20 Claims, 3 Drawing Sheets

TWO-PIECE NAILER MAGAZINE AND METHOD THEREFOR

BACKGROUND OF THE INVENTION

The invention relates generally to nailing tools, and more particularly nailing tools having magazines for collated strips of nails.

Nailing tools having a magazine for housing a collated strip of nails or brads are known generally and used widely in finish, frame, pallet and roof nailing applications. The magazines comprise generally a longitudinal channel formed between opposing side walls thereof for accommodating the strip of nails. A front end of the magazine is coupled to a nosepiece of the tool to supply individual nails from the collated strip thereto, and another portion thereof is often coupled to some other part of the tool for additional support, as is known generally. In operation, a spring in the magazine biases the collated strip of nails housed therein toward the nosepiece, where the nails are sheared individually from the collated strip by a blade that drives the nails into a work piece.

The Model F-350S strip nailer tool manufactured by ITW Paslode, Vernon Hills, Ill. for example comprises a one-piece magazine formed as a unitary member in an extruding process. Prior art FIG. 4 of the present application illustrates a partial view of the magazine 10 of the Model F-350S tool and more particularly a sectional view of the opposing side walls 11 and 12 thereof after extruding.

The extruded one-piece magazine 10 of prior art FIG. 4 however requires several costly machining operations after extruding to complete the fabrication thereof. For example, a longitudinal slot is formed along a top portion of the magazine to accommodate the strip of nails by removing material 13 indicated by phantom lines. The removal of material 13 is performed in a two step milling process including a rough cutting operation that separates the first and second side walls 11 and 12, and a subsequent precision cutting operation performed with a spacer placed temporarily between the opposing side walls to maintain proper spacing therebetween during the precision cutting operation. Various other costly machining operations are also performed on the one-piece magazine, for example front and rear end surfaces of the magazine and window openings therethrough are formed in milling operations, and transverse bolt openings in the magazine are formed in drilling operations.

Other nailing tool magazines are formed as an assembly comprising two separately extruded side wall portions, or halves. The known two-piece magazine assemblies however generally require a permanent spacer between the opposing side wall portions thereof to accurately form a channel therebetween to accommodate the collated strip of nails. In U.S. Pat. No. 5,839,638 entitled "Pneumatic Trim Nailer", issued on Nov. 24, 1998 and assigned commonly herewith, for example, tapered spacer members are disposed in openings formed between opposing side wall portions on opposing ends of the magazine.

Prior art FIG. 5 of the present application illustrates more particularly an end view of a two-part magazine 20 typical of the type disclosed in the referenced U.S. Pat. No. 5,839,638 having mating side wall portions 21 and 22 with an opening 23 therebetween for accommodating a tapered spacer member, usually in the form of a threaded fastener, to space and interlock the side wall portions. The magazine of U.S. Pat. No. 5,839,638 also requires longitudinal openings 25 for receiving bolts that fasten an end cap thereon.

The present invention is drawn toward advancements in the art of nailing tool magazines for collated strips of nails, sometimes referred to merely as strips of nails.

An object of the invention is to provide novel two-piece magazines for strips of nails in nailing tools, combinations thereof and methods therefor that overcome problems in the art.

Another object of the invention is to provide novel two-piece magazines for strips of nails in nailing tools, combinations thereof and methods therefor that are economical.

Another object of the invention is to provide novel two-piece magazines for strips of nails in nailing tools, combinations thereof and methods therefor that do not require spacers.

Another object of the invention is to provide novel two-piece magazines for strips of nails in nailing tools, combinations thereof and methods therefor that do not require the formation of a slot along a top portion thereof in a machining operation.

Another object of the invention is to provide novel two-piece magazines for strips of nails in nailing tools and methods therefor having first and second magazine portions that are fabricated partially in corresponding extruding operations.

Another object of the invention is to provide novel two-piece magazines for strips of nails in nailing tools and methods therefor having first and second magazine portions with corresponding wear strip mounting portions that are formed by extrusion.

Another object of the invention is to provide novel two-piece magazines for strips of nails in nailing tools and combinations thereof and methods therefor that are fabricated in one or more stamping operations after extrusion.

A more particular object of the invention is to provide novel two-piece magazines for strips of nails in nailing tools, combinations thereof and methods therefor comprising generally first and second magazine portions each having an elongated side wall with front and rear end portions. The first magazine portion includes a first lower portion with a tongue protruding therefrom, and the second magazine portion includes a second lower portion with a groove. The tongue is disposable and frictionally retainable in the groove to assemble the first and second magazine portions.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

BRIEF DESCRIPTION OF THE DRAWINGS

Prior art

Prior art

DETAILED DESCRIPTION OF THE INVENTION

Figure 1:
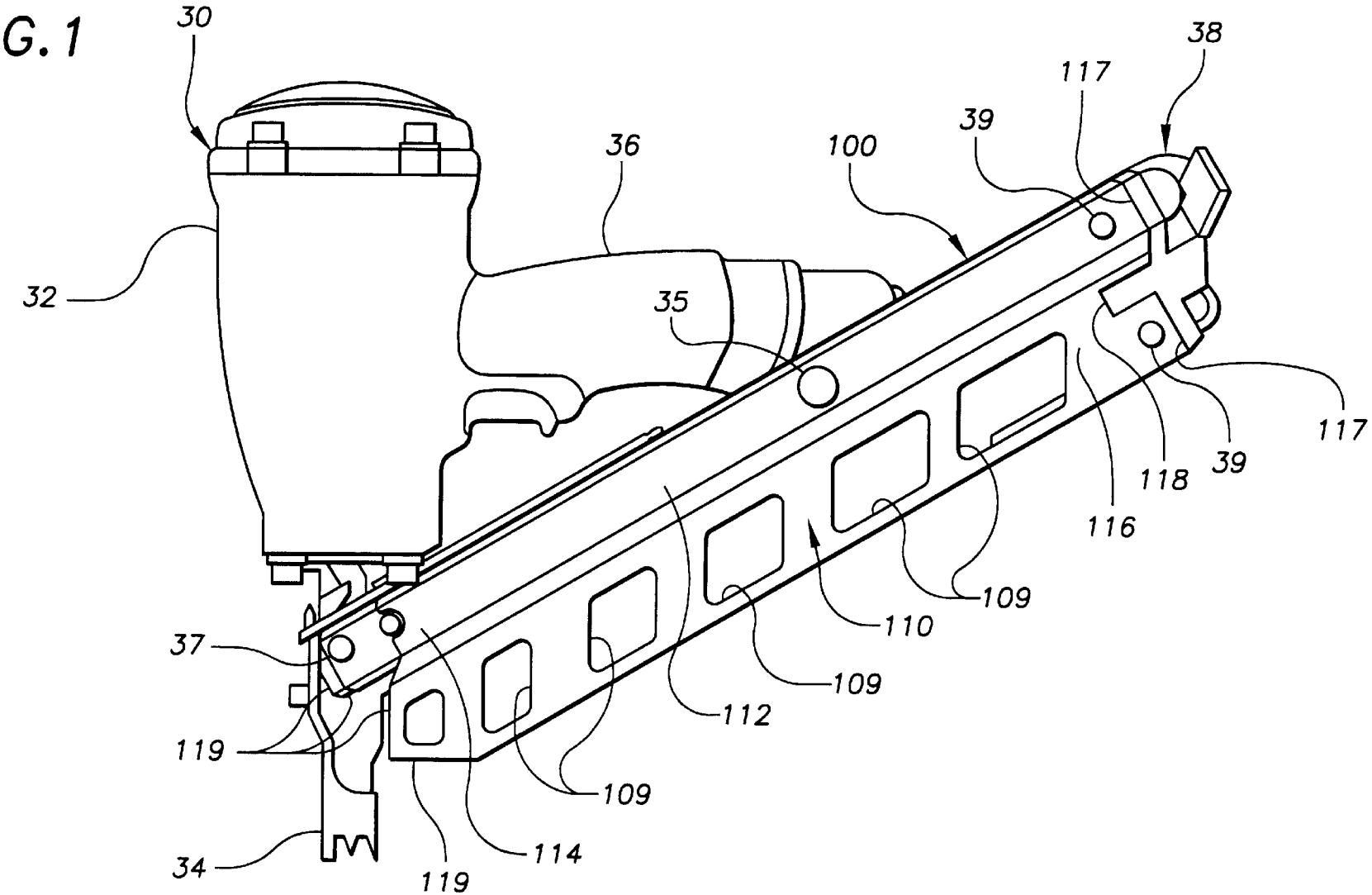
FIG. 1 is a nailing tool having a two-piece magazine for collated strips of nails according to an exemplary embodiment of the invention.

FIG. 1 illustrates a fastener driving tool 30 comprising generally a body member 32 with a nosepiece 34 and a handle 36 extending therefrom. The tool also comprises a fastener driving tool magazine 100 for receiving a collated strip of fasteners. The magazine 100 is coupled generally at a front end portion thereof to the nosepiece 34 of the tool and preferably to some other portion of the tool, for example the handle 36 thereof. An opposing rear end portion of the tool usually includes an end cap 38 mounted and retained on a surface 117 thereof by one or more fasteners disposed through transverse openings therein.

Generally, the magazine 100 sequentially feeds fasteners from the collated strip to the nosepiece 34, and a blade in the nosepiece shears individual fasteners from the collated strip and drives them into a workpiece during operation of the tool, as is well known.

The exemplary fastener driving tool 30 is a pneumatically operated strip nailing tool, but in other embodiments the tool may be a frame, pallet, or roofnailing tool among other tools having a magazine for housing collated strips of fasteners. The tool 30 may also be powered by means other than air supplied from a pneumatic umbilical cord. The tool may be powered for example by a gas supplied from a cartridge disposed in or on the tool.

Figure 2:
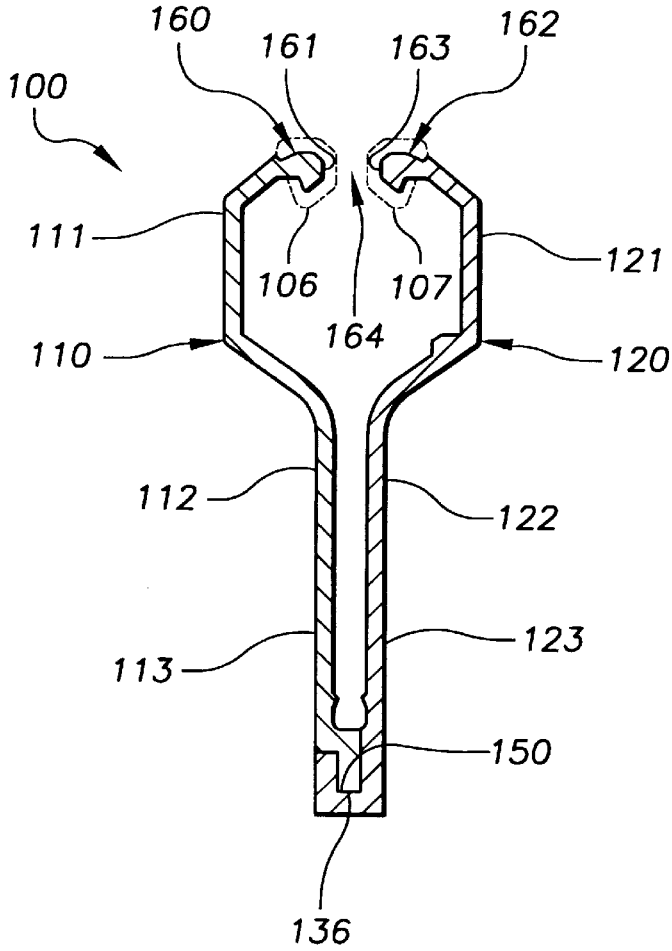
FIG. 2 is a partial sectional view of a two-piece magazine according to an exemplary embodiment of the invention.

In FIG. 2, the magazine comprises generally a first magazine portion 110 having an elongated first side wall 112 and a second magazine portion 120 having an elongated second side wall 122 generally opposite the elongated first side wall 112 of the first magazine portion 110. The side walls and upper portions of the first and second magazine portions 110 and 120 are substantially mirror images of each other, as illustrated in FIG. 2. The first and second lower portions of the first and second magazine portions are configured generally for cooperative engagement, and are therefore different from each other as discussed more fully below.

The first and second magazine portions 110 and 120 also comprise generally corresponding first and second front end portions couplable to the nosepiece of the tool, and corresponding first and second rear end portions. FIG. 1 illustrates the first magazine portion 110 comprising an elongated first side wall 112, a first front end portion 114 with front end surfaces 119, and a first rear end portion 116 with rear end surfaces 117. The second front and rear end surfaces of the second magazine portion are the same as or similar to those illustrated in FIG. 1. More generally, however, the front and rear end surfaces of the first and second magazine portions 110 and 120 have different shapes, as may be required for mounting to a particular nosepiece of the tool and for accommodating a particular end cap. The precise shape or structure of the front and rear end surfaces of the first and second magazine portions 110 and 120 is thus immaterial, and is not intended to limit the scope of the invention.

The first magazine portion comprises a first lower portion having a tongue protruding therefrom, and the second magazine portion also comprises a second lower portion but with a recess, or groove. Generally, the first and second magazine portions are assembled by disposing the tongue of the first magazine portion into the groove of the second magazine portion, where the tongue is retained frictionally without the requirement for spacers or other fastening means as is required in known prior art two-part magazines.

Figure 3A:
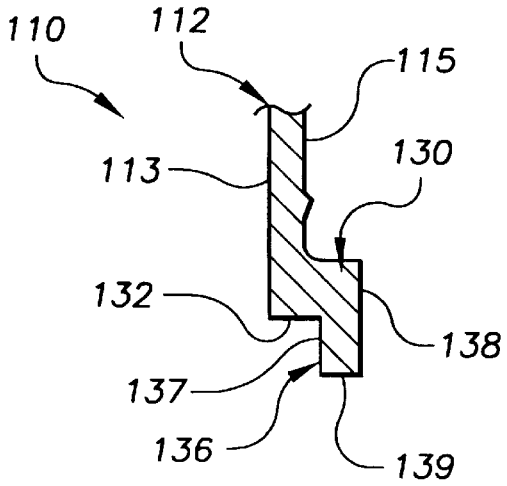
FIG. 3*a* is an enlarged partial view of a first side portion of a two-piece magazine according to the present invention.

In FIG. 3*a*, the first side wall 112 has a lower portion 113 with a first inner side 115 and a first flange 130 extending laterally therefrom. A tongue 136 protrudes downwardly from the first flange 130, where it is offset laterally relative to the side wall 112. The tongue 136 protruding from the first lower portion 113 of the first magazine portion 110 extends preferably continuously along a substantial portion between the first front and rear end portions thereof. In alternative embodiments, however the tongue may comprise a series of discrete members, or teeth, protruding from the first magazine portion.

Figure 3B:
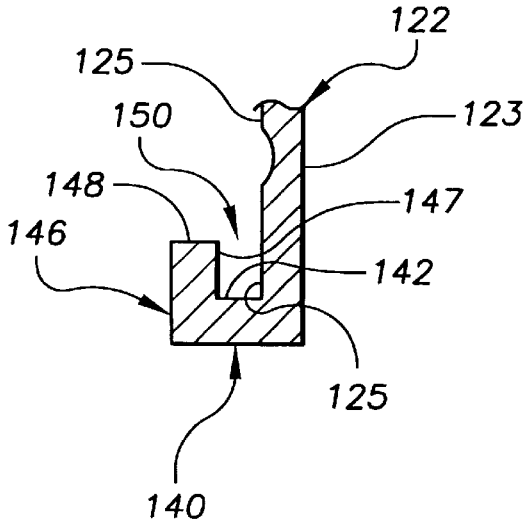
FIG. 3*b* is an enlarged partial view of a second side portion of a two-piece magazine according to the present invention.
Figure 4:
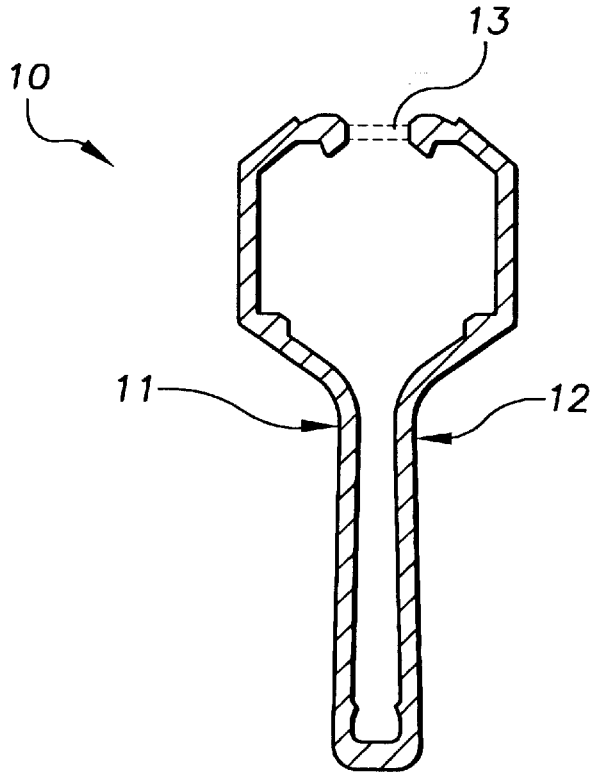
FIG. 4 PRIOR ART
FIG. 4 is a sectional view of a known one-piece magazine.
Figure 5:
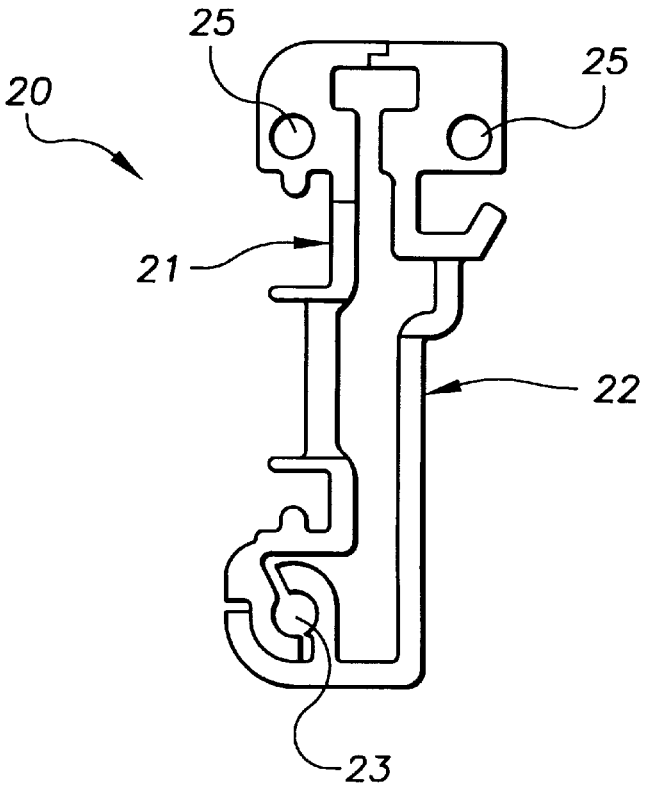
FIG. 5 PRIOR ART
FIG. 5 is an end view of a known two-piece magazine.

In FIG. 3*b*, the second side wall 122 has a lower portion 123 with a second inner side 125 and a second flange 140 extending laterally therefrom. A lip 146 extends upwardly from the second flange 140, and is spaced apart from the second side wall 122, thereby forming a groove 150 between the lip 146 and the lower portion 123 of the second side wall 122, with the second flange 140 extending therebetween. The groove 150 is formed along the second lower portion of the second magazine portion and extends preferably continuously along a substantial portion between the second front and rear end portions thereof.

FIG. 2 illustrates the first and second magazine portions 110 and 120 assembled, wherein the tongue 136 is frictionally engaged and retained frictionally in the groove 150, without the use of spacers, as in prior art two-part magazines. In the exemplary embodiment, the tongue 136 may be disposed in the groove 150 from above when the first and second magazine portions are aligned side by side, or alternatively the tongue may be slidably disposed into the groove from either end thereof. The end cap is then mounted and fastened on the rear end surfaces of the first and second magazine portions as illustrated in FIG. 1.

In FIGS. 3*a* and 3*b*, the tongue 136 has a first side portion 137 that frictionally engages the lip and more particularly an inner side portion 147 thereof when the tongue is disposed in the groove. The tongue also has a second side portion 138 that frictionally engages the second inner side 125 of the second side wall when the tongue is disposed in the groove. The tongue and groove thus locate and accurately space the first and second side walls 112 and 122 of the assembled first and second magazine portions 110 and 120, as illustrated in FIG. 2. Additionally, the end cap 38 on the rear end surfaces of the assembled first and second magazine portions, illustrated in FIG. 1, further maintains the precise spacing therebetween.

In FIG. 2, a first upper wall portion 111 of the first magazine portion 110 has a first wear strip mounting portion 160 thereon, and a second upper wall portion 121 of the second magazine portion 120 has a second wear strip mounting portion 162 thereon. The first and second wear strip mounting portions extend generally continuously between the front and rear end portions of the first and second magazine portions.

The first wear strip mounting portion 160 has a first inner side portion 161 generally opposite and spaced apart from a second inner side portion 163 of the second wear strip mounting portion 162 thus forming a longitudinal slot 164 therebetween when the first and second magazine portions 110 and 120 are assembled. The alignment and spacing between the first and second inner side portions 161 and 163 of the first and second wear strip mounting portions is a critical dimension in the assembled magazine, since the longitudinal slot 164 formed thereby must accommodate the collated strip of brads without jamming.

In FIGS. 3*a* and 3*b*, the tongue 136 has a lower portion 139 that is disposed adjacent an upper portion 142 of the second flange 140 when the tongue is disposed in the groove. The first flange 130 also has a lower portion 132 that is disposed adjacent an upper portion 148 of the lip 146 when the tongue is disposed in the groove. When the first and second magazine portions 110 and 120 are assembled, preferably, the lower portion 139 of the tongue is engaged with the upper portion 142 of the second flange and the lower portion 132 of the first flange is engaged with the upper portion 148 of the lip, thereby aligning the first and second magazine portions 110 and 120, and more particularly oppositely aligning the corresponding first and second inner side portions 161 and 163 of the first and second wear strip mounting portions 160 and 162. Alternatively, only the lower portion 139 of the tongue engaged with the upper portion 142 of the second flange or only the lower portion 132 of the first flange engaged with the upper portion 148 of the lip may align the first and second inner side portions 161 and 163 to form the slot therebetween.

FIG. 2 illustrates in phantom lines first and second wear strips 106 and 107, made for example from a stainless steel material, mounted on the corresponding first and second wear strip mounting portions 160 and 162, as is known generally. In other embodiments, however, the wear strips 106 and 107 are not included as part of the magazine 100, and in this alternative configuration the collated strips of nails are disposed directly between the first and second inner side portions of the wear strip mounting portions, which may be configured differently since it is not necessary to retain the wear strips thereon.

The first and second magazine portions 110 and 120 are formed preferably by extrusion, for example by extruding aluminum or plastic or some other extrudable material. The first and second magazine portions 110 and 120 are formed preferably from continuously extruded first and second members. In other words, the first and second magazine portions 110 and 120 may be formed from relatively long pieces of extruded stock material having the desired cross-sectional configuration upon subsequent fabrication operations, preferably one or more stamping operations, as discussed further below.

The cross-sectional configuration of the extruded first and second magazine members may more generally be different than the exemplary embodiment of FIG. 2, which is not intended to limit the scope of the present invention. The cross-sectional configuration of the extruded first and second magazine members, however, will include generally structure that permits frictional engagement of the first and second members along the lower portions thereof, for example with the exemplary tongue and groove configuration illustrated in FIG. 2, and provide a slot between upper portions thereof when assembled for accommodating the strip of nails therebetween, for example between wear strip mounting portions formed thereon. The other structural features of the first and second magazine portions, including the front and rear end surfaces, are formed in subsequent operations, preferably stamping operations.

In the exemplary embodiment of FIG. 2, the first magazine member that forms the first magazine portion 110 is extruded to have the elongated first side wall 112 with the first lower portion 113 having the tongue 136 protruding therefrom, andthe second magazine member that forms the second magazine portion 120 is extruded to have the elongated second side wall 122 with the second lower portion 123 having the groove 150 thereon. In FIG. 3, more particularly, the first magazine member is extruded to have the tongue 136 protruding downwardly from the first flange 130 extending laterally from the first side wall 112 along the lower portion 113 thereof, and the second magazine member is extruded to have the groove 150 formed between the portion of the second side wall 122 and the lip 146 spaced apart therefrom with the second flange 140 extending therebetween.

As discussed above, the tongue 136 of the first magazine portion 110 is disposable and frictionally retainable in the groove 150 of the second magazine portion when the first and second magazine portions are assembled, without the use of spacers as is required in prior art two-piece magazines. The friction fit of the tongue 136 and the groove 150 can be controlled precisely and cost effectively when the tongue and groove are formed by extruding the first and second magazine members from which the first and second magazine portions 110 and 120 are formed. The lower portion of the magazine may thus be assembled and used without the need for additional fasteners, other than those required to lock the magazine onto the tool and the end piece, if any.

In FIG. 2, the extruded first and second magazine members that form the first and second magazine portions 110 and 120 are also extruded to have corresponding first and second wear strip mounting portions 160 and 162 on the corresponding first and second upper wall portions 111 and 121 thereof. Forming the first and second wear strip mounting portions 160 and 162 during the extrusion of the first and second magazine members precisely controls the dimensions of the longitudinal slot formed therebetween when the magazine portions are —assembled, and eliminates the requirement for costly machining operations required to form the slot as in prior art single-piece magazines. As suggested above, the first and second wear strip mounting portions may be configured for mounting the wear strips thereon or may be configured for accommodating the collated strips of nails without the use of wear strips.

After extruding the first and second magazine members having the desired cross-sectional configuration, for example as illustrated in FIG. 2, front and rear end surfaces are formed thereon preferably in stamping operations, thus forming the first and second magazine portions.

In the exemplary embodiment of FIG. 1, for example, the rear end surfaces 117 and a notch 118 are formed on the rear end portion 116 of the first magazine portion 110 in a stamping operation. A similar notched surface may be formed on the second rear end portion of the second magazine portion. Additionally, the one or more transverse openings 39 through the rear end portions of the first and second magazine portions may also be formed in a stamping operation. Also, in FIG. 1, a transverse mounting opening 35 may be stamped through the first and second magazine portions for mounting the magazine 100 on the tool 30. In other embodiments, the rear end surface configuration and transverse openings may be different than those illustrated depending on the requirements of the particular application, for example for different end cap configurations and for different tool mounting locations.

In the exemplary embodiment of FIG. 1, the front end surfaces 119 are formed on the front end portion 114 of the first magazine portion 110 also preferably in a stamping operation. A similar notched surface may be formed on the second front end portion of the second magazine portion. Additionally, the one or more transverse openings 37 on the front end portions of the first and second magazine portions may also be formed in a stamping operation. In other embodiments, the front end surface configuration and transverse opening configuration may be different depending on the requirements of the particular application, for example for mounting on a nosepiece configured differently than that illustrated in the exemplary embodiment of FIG. 1.

In the exemplary embodiment of FIG. 1, a plurality of windows 109 are formed through the first magazine portion 110 between the front and rear end portions thereof, preferably in one or more stamping operations. Similar windows may be stamped in the second magazine portion. In prior art one-piece magazines, it is not possible to form these windows in stamping operations, and thus they are formed in costly milling or other operations.

In some two-piece magazine embodiments, there may be some surfaces or structure on the first and second magazine portions that may not be formed in stamping operations, depending on the particular application requirements. Generally though by forming the first and second magazine portions 110 and 120 from separately extruded first and second members as in the present invention, at least some and in many cases most if not all of the surfaces and openings thereof may be formed in stamping operations, which are very economical in comparison to the costly milling and drilling operations required in prior art magazines.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A fastener driving tool magazine for receiving a collated strip of fasteners, the magazine comprising:

a first magazine portion having an elongated first side wall with a first front end portion and a first rear end portion, the first magazine portion having a first upper portion extending between the first front and rear end portions thereof, the first magazine portion having a first lower portion extending between the first front and rear end portions thereof, a tongue protruding from the first lower portion of the first magazine portion between the front and rear end portions thereof;

a second magazine portion having an elongated second side wall with a second front end portion and a second rear end portion, the second magazine portion having a second upper portion extending between the second front and rear end portions thereof, the second magazine portion having a second lower portion extending between the second front and rear end thereof, a groove disposed along the second lower portion of the second magazine portion between the second front and rear end portions thereof, the tongue of the first magazine portion is disposable and functionally retainable in the groove of the second magazine portion, the first side wall spaced apart from the second side wall when the tongue is disposed and frictionally retained in the groove, a top loading slot separating the first upper portion of the first magazine portion from the second upper portion of the second magazine portion between the front and rear end portions thereof when the tongue is disposed and frictionally retained in the groove.

2. The magazine of claim 1, the tongue protruding from the first lower portion of the first magazine portion extends continuously along a substantial portion between the first front and rear end portions thereof, and the groove on the second lower portion of the second magazine portion extends continuously along a substantial portion between the second front and rear end portions thereof.

3. The magazine of claim 1, the first side wall has a first inner side with a first flange extending laterally therefrom, the first flange is disposed along a first lower portion of the first side wall, the tongue protrudes downwardly from the first flange, the groove has opposite side walls between which the tongue is frictionally disposed and retained.

4. The magazine of claim 3, the second side wall has a second inner side with a second flange extending laterally therefrom, the second flange is disposed along a second lower portion of the second side wall, a lip extends upwardly from the second flange, the lip is spaced apart from the second side wall, the groove of the second magazine portion is formed between the lip and a portion of the second side wall with the second flange extending therebetween.

5. The magazine of claim 4, the tongue has first and second side portions, the first side portion of the tongue is frictionally engaged with the lip, and the second side portion of the tongue is frictionally engaged with the second inner side of the second side wall.

6. The magazine of claim 5, a lower portion of the tongue is adjacent an upper portion of the second flange, and a lower p of the first flange is adjacent an upper portion of the lip.

7. The magazine of claim 1, a first wear strip mounting portion on the first upper portion of the first magazine portion, a second wear strip mounting portion on the second upper portion of the second magazine portion, the first wear strip mounting portion spaced apart from the second wear strip mounting portion to form the slot between the first and second magazine portions.

8. The magazine of claim 1, the first magazine portion is formed from a first extruded member, the second magazine portion is formed from a second extruded member.

9. The magazine of claim 8, the first and second magazine portions are aluminum.

10. The magazine of claim 1, the first and second magazine portions are assembled in spaced apart relation by no more than the tongue of the first magazine portion disposed and frictionally retained in the groove of the second magazine portion.

11. A fastener driving tool having a nosepiece that sequentially receives individual fasteners from a collated strip of fasteners, comprising:

a first magazine portion having an elongated first side wall with a first front end portion and a first rear end portion, a tongue protruding from a first lower portion of the first magazine portion, the tongue extending between the first front and rear end portions of the first magazine portion;

a second magazine portion having an elongated second side wall with a second front end portion and a second rear end portion, a groove along a second lower portion of a second magazine portion, the groove extending between the second front and rear end portions of the second magazine portion, the first and second magazine portions are assembled with the first elongated side wall spaced apart from the second elongated side wall by engagement between only the tongue of the first magazine portion disposed and frictionally retained in the groove of the second magazine portion, a slot separating a first upper portion of the first magazine portion from a second upper portion of the second magazine portion, the slot disposed between the front and rear end portions of the first and second magazine portions, the first and second front end portions of the first and second magazine portions are coupled to the nosepiece of the tool.

12. The tool of claim 11, the first side wall has a first inner side with a first flange extending laterally therefrom, the first flange is disposed along a first lower portion of the first side wall, the tongue protrudes downwardly from the first flange, the second side wall has a second inner side with a second flange extending laterally therefrom, the second flange is disposed along a second lower portion of the second side wall, a lip extends upwardly from the second flange, the lip is spaced apart from the second side wall, the tongue has first and second side portions, the first side portion of the tongue is frictionally engaged with the lip, and the second side portion of the tongue is frictionally engaged with the second inner side of the second side wall.

13. The tool of claim 11, a first wear strip mounting portion on the first upper portion of the first magazine portion, a second wear strip mounting portion on the second upper portion of the second magazine portion, the first wear strip mounting portion is spaced apart from the second wear strip mounting portion to form the slot.

14. The tool of claim 11, the first magazine portion is formed from a first extruded member, the second magazine portion is formed from a second extruded member.

15. The tool of claim 14, the first and second magazine portions are aluminum.

16. A method for making a tot loading fastener driving tool magazine for receiving a collated strip of fasteners, the method comprising:

extending a first magazine member having an elongated first side wall with a first upper portion and a first lower portion having a tongue protruding therefrom;

extruding a second magazine member having an elongated second side wall with a second upper portion and a second lower portion having a groove;

spacing the first side wall from the second side wall with a top loading so between the first and second upper portions of the first and second magazine members by disposing and frictionally retaining the tongue in the groove.

17. The method of claim 16 further comprising extruding the first magazine member having a first wear strip mounting portion on a first upper wall portion thereof, extruding the second magazine member having a second wear strip mounting portion on a second upper wall portion thereof.

18. The method of claim 16, extruding the first magazine member having the tongue protruding downwardly from a first flange extending laterally from the first side wall along a lower portion thereof, extruding the second magazine member having the groove formed by a portion of the second side wall, by a second flange extending laterally from a lower portion thereof, and by a lip spaced apart from the second side wall and extending upwardly from the second flange, and assembling the first and second magazine members by frictionally engaging a first side portion of the tongue with the lip and frictionally engaging a second side portion of the tongue with the second side wall.

19. The method of claim 16 further comprising continuously extruding the first and second magazine members, and stamping front and rear end surfaces on portions of the first and second magazine members to form first and second magazine portions.

20. The method of claim 16 further comprising stamping front and rear end surfaces on the first and second magazine members to form first and second magazine portions, and stamping transverse openings through the first and second magazine members.

* * * * *